US012692684B2

(12) United States Patent
Keeley et al.

(10) Patent No.: US 12,692,684 B2
(45) Date of Patent: Jul. 28, 2026

(54) ADDITIVE DOSING ASSEMBLIES AND HYDRO EXCAVATION VACUUM APPARATUS INCORPORATING SAME

(71) Applicant: Vermeer Manufacturing Company, Pella, IA (US)

(72) Inventors: Jacob Keeley, Prairie City, IA (US); Nathan Meyer, Knoxville, IA (US)

(73) Assignee: Vermeer Manufacturing Company, Pella, IA (US)

( * ) Notice: Subject to any disclaimer, the term of this patent is extended or adjusted under 35 U.S.C. 154(b) by 1070 days.

(21) Appl. No.: 17/808,900

(22) Filed: Jun. 24, 2022

(65) Prior Publication Data

US 2022/0412044 A1 Dec. 29, 2022

Related U.S. Application Data

(60) Provisional application No. 63/216,254, filed on Jun. 29, 2021.

(51) Int. Cl.

| | |
|---|---|
| ***E02F 3/90*** | (2006.01) |
| ***E02F 3/88*** | (2006.01) |
| ***E02F 3/92*** | (2006.01) |

(52) U.S. Cl.

CPC ..... *E02F 3/902* (2013.01); *E02F 3/8816* (2013.01); *E02F 3/907* (2013.01); *E02F 3/9262* (2013.01)

(58) Field of Classification Search

CPC . E02F 3/94; E02F 3/8816; E02F 3/902; E02F 3/907; E02F 3/9262; E02F 9/2025; E02F 9/26; A01C 23/025

See application file for complete search history.

(56) References Cited

U.S. PATENT DOCUMENTS

| | | | | |
|---|---|---|---|---|
| 3,930,324 A * | 1/1976 | Wightman | ..... | E02F 3/8825 37/189 |
| 4,018,483 A * | 4/1977 | Smith | ..... | B65G 53/42 15/409 |
| 4,271,617 A | 6/1981 | Yoshizawa | | |
| 4,378,290 A * | 3/1983 | Kennedy, Jr. | ..... | B01D 21/34 210/120 |

(Continued)

FOREIGN PATENT DOCUMENTS

| | | |
|---|---|---|
| CA | 2104723 A1 | 2/1995 |
| CN | 212129019 U | 12/2020 |

(Continued)

OTHER PUBLICATIONS

VX30 / VX50 Gen 3 / ECO05 Vacuum Excavators Operator's and Maintenance Manual, 2019, Vermeer Corporation, pp. 1-210.

*Primary Examiner* — Christopher J Sebesta
*Assistant Examiner* — Audrey L Lusk
(74) *Attorney, Agent, or Firm* — Armstrong Teasdale LLP

(57) ABSTRACT

Hydro excavation apparatus for excavating earthen material are disclosed. The hydro excavation apparatus includes a first reservoir for holding a base fluid therein, a second reservoir for holding an additive therein, a vacuum system for removing earthen material from an excavation site, and an additive dosing assembly. The additive dosing assembly includes at least one of a pump and a valve fluidly connected to the second reservoir. The additive dosing assembly is selectively controllable to introduce an additive into at least one of the base fluid and the removed earthen material.

17 Claims, 6 Drawing Sheets

(56) References Cited

U.S. PATENT DOCUMENTS

| | | | | |
|---|---|---|---|---|
| 5,376,182 | A * | 12/1994 | Everett | B09C 1/02 134/1 |
| 6,470,605 | B1 * | 10/2002 | Gilman | E21B 7/18 37/323 |
| 6,484,422 | B1 * | 11/2002 | Bain | E02F 3/8825 37/323 |
| 7,484,322 | B2 * | 2/2009 | Maybury, Jr. | E02F 5/226 406/88 |
| 8,156,666 | B1 * | 4/2012 | Deal, Jr. | E02F 3/8825 37/317 |
| 2002/0189139 | A1 * | 12/2002 | Buckner | E21B 21/066 37/317 |
| 2006/0086010 | A1 * | 4/2006 | Jarnecke | E02F 3/925 37/317 |
| 2006/0123745 | A1 | 6/2006 | Pobihushchy | |
| 2010/0196129 | A1 * | 8/2010 | Buckner | E02F 3/8825 15/340.1 |
| 2013/0274925 | A1 * | 10/2013 | Oates, Jr. | E02F 9/267 700/275 |
| 2019/0015766 | A1 | 1/2019 | Hofland et al. | |
| 2019/0017243 | A1 * | 1/2019 | Strobel | B01D 33/0353 |
| 2020/0398320 | A1 | 12/2020 | Cole et al. | |
| 2021/0087784 | A1 | 3/2021 | Anderson et al. | |

FOREIGN PATENT DOCUMENTS

| | | | |
|---|---|---|---|
| CN | 112492947 | A | 3/2021 |
| EP | 0400025 | B1 | 9/1993 |
| KR | 200392369 | Y1 | 8/2005 |
| WO | 2019036018 | A1 | 2/2019 |

* cited by examiner

ADDITIVE DOSING ASSEMBLIES AND HYDRO EXCAVATION VACUUM APPARATUS INCORPORATING SAME

CROSS-REFERENCE TO RELATED APPLICATIONS

This application claims the benefit of U.S. Provisional Patent Application No. 63/216,254, filed Jun. 29, 2021, which is incorporated herein by reference it its entirety.

FIELD OF THE DISCLOSURE

The field of the disclosure relates to hydro excavation apparatuses and, in particular, mobile hydro excavation apparatuses that include additive dosing assemblies for adding an additive to an excavation fluid solution.

BACKGROUND

Hydro vacuum excavation involves directing high pressure fluid at an excavation site while removing cut earthen material and water by a vacuum system. Sites may be excavated to locate utilities or to cut trenches. The spoil material is removed by entraining the spoil material in an airstream generated by the vacuum system. After being entrained in the airstream, some spoil material may interfere with and/or attach to the internal components of the vacuum system or other systems.

Some hydro vacuum excavation systems use an excavation fluid solution that includes a softening additive, such as soap or laundry detergent, in addition to water. The addition of the additive in the fluid can reduce the surface tension of certain soils, thereby reducing interference between the spoil material and the vacuum systems after the spoil material is entrained. Conventionally, such hydro vacuum excavation systems include a base fluid tank that hold a base fluid (such as water, for example). To introduce the additive into the base fluid, the tank is "manually batch dosed" by an operator who pours a volume of additive from a detergent canister into the tank until the resulting fluid solution in the tank contains a desired concentration of additive. However, an optimal additive concentration in the excavating solution may vary depending on the soil conditions of an excavating site. Additionally, adjusting the additive concentration after the tank has been batch dosed often requires fully discharging and refilling the tank to the desired concentration, resulting in wasted solution and increasing costs. Moreover, inlets for introducing the additives in the base fluid tanks are not configured for introducing additives and are often located in areas that are difficult for operators to reach when manually adding the additive to the base fluid.

A need exists for a hydro excavation apparatus that includes an additive system that controls addition of additive to the base fluid or spoil material during excavation.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

One aspect of the present disclosure is directed toward a hydro excavation apparatus for excavating earthen material. The apparatus includes a first reservoir for holding a base fluid therein, a second reservoir for holding an additive therein, a vacuum system for removing earthen material from an excavation site, and an additive dosing assembly. The additive dosing assembly includes at least one of a pump and a valve fluidly connected to the second reservoir. The additive dosing assembly is selectively controllable to introduce an additive into at least one of the base fluid and the removed earthen material.

Another aspect of the present disclosure is directed toward a hydro excavation apparatus for excavating earthen material. The apparatus includes a reservoir for holding a base fluid therein and an additive dosing assembly for introducing an additive into the base fluid to form a mixed fluid solution. The apparatus further includes a wand for directing the mixed fluid solution toward earthen material at an excavation site to cut the earthen material and a vacuum system for removing the cut earthen material and the mixed fluid solution from the excavation site.

Another aspect of the present disclosure is directed toward a method for controlling a hydro excavation apparatus. The method includes providing an additive dosing assembly that includes at least one of a pump and a valve that is fluidly connected to an additive reservoir storing an additive therein. The method further includes cutting earthen material at an excavation site using a pressurized base fluid, where the base fluid is stored in a base fluid reservoir of the hydro excavation apparatus. The method further includes controlling a vacuum system to remove the cut earthen material from the excavation site and controlling the additive dosing assembly to selectively introduce the additive into at least one of the removed earthen material and the base fluid.

Another aspect of the present disclosure is directed toward a hydro excavation apparatus for excavating earthen material that includes a first reservoir for holding a base fluid therein and a wand for directing a mixed fluid solution toward earthen material to cut the earthen material at an excavation site. The apparatus further includes a fluid supply line fluidly connecting the first reservoir to the wand and an additive dosing assembly for introducing an additive into the base fluid to form the mixed fluid solution. The additive dosing assembly includes a second reservoir for holding the additive therein and a positive displacement pump fluidly connecting the second reservoir with the fluid supply line. The positive displacement pump is controllable to selectively release the additive into the fluid supply line.

Another aspect of the present disclosure is directed toward a fluid supply system for discharging an excavating fluid solution. The fluid supply system includes a first reservoir for holding a base fluid therein, a second reservoir for holding an additive therein, and an additive dosing assembly for introducing the additive into the base fluid to form the excavating fluid solution. The additive dosing assembly includes a pump fluidly connected to the second reservoir and a motor operatively connected to the pump. The fluid supply system further includes an excavation fluid pump fluidly connected to the first reservoir that is operable to pressurize the excavating fluid solution, and a control system operable to control the additive dosing assembly to introduce the additive into the base fluid.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

Figure 1:
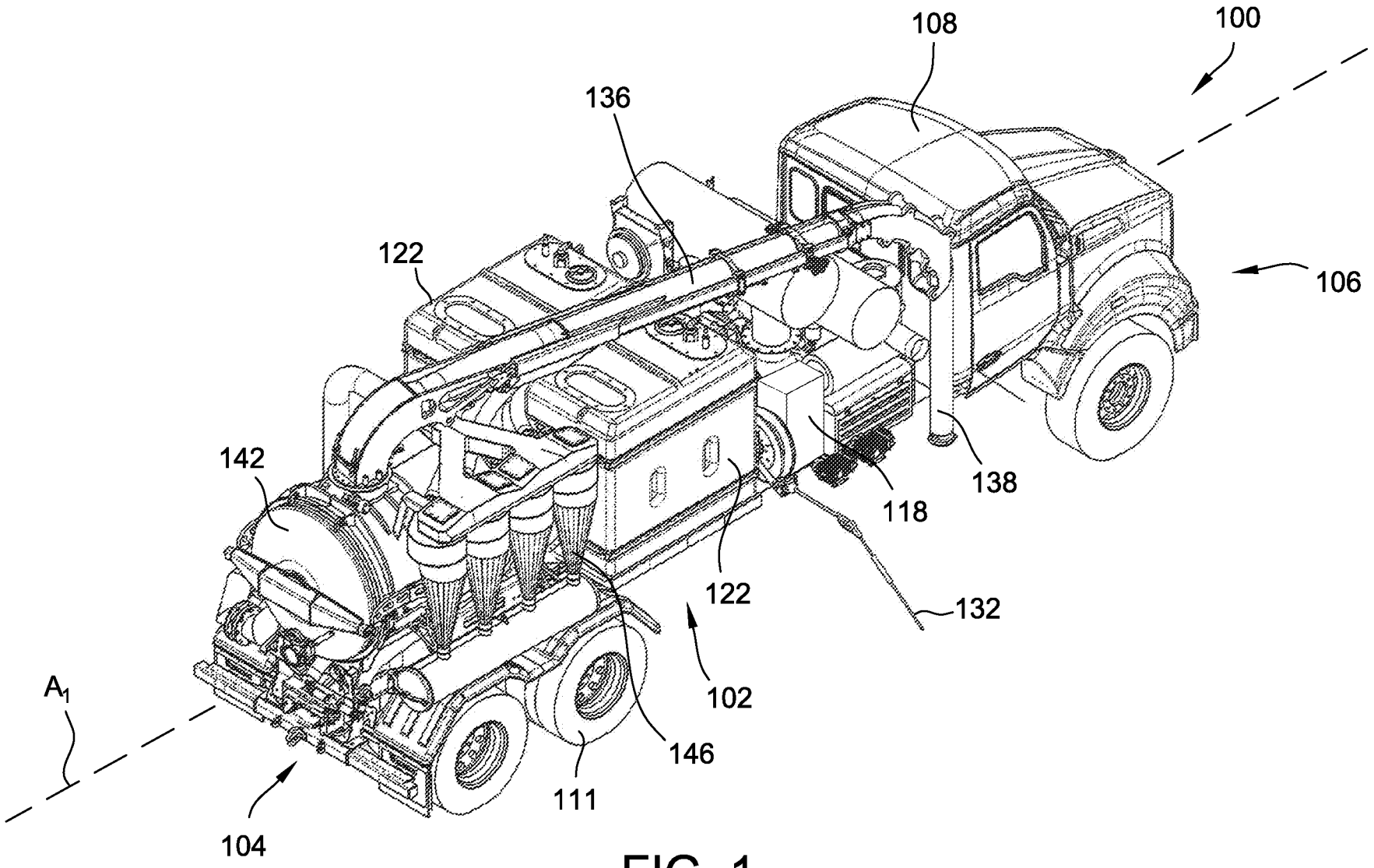
FIG. 1 is a perspective view of a hydro excavation vacuum apparatus.

An example hydro excavation vacuum apparatus 100 for excavating earthen material is shown in FIG. 1. As described in further detail herein, the hydro excavation vacuum apparatus 100 is used to excavate a site by use of a jet of high pressure fluid solution expelled through a wand 132. The cut earthen material and water are removed by a vacuum system 114 (FIG. 2A) and discharged into a collection vessel 142.

The hydro excavation vacuum apparatus 100 includes a chassis 102 which supports the various components (e.g., vacuum system 114, collection tank 142, cyclones 146) with wheels 111 connected to the chassis 102 to transport the apparatus 100. The apparatus 100 may be self-propelled (e.g., with a dedicated motor that propels the apparatus) or may be adapted to be towed by a separate vehicle (e.g., may include a tongue and/or hitch coupler to connect to the separate vehicle). The hydro excavation vacuum apparatus 100 includes a rear 104, a front 106, and a longitudinal axis A1 that extends through the front 106 and the rear 104 of the hydro excavation vacuum apparatus 100. The hydro excavation vacuum apparatus 100 includes a cab 108 arranged near the front 106. The various components of the hydro excavation vacuum apparatus 100, such as the excavation pump 125 (FIG. 2A), vacuum pump 140, and the like, are powered by an engine (not shown) that propels the apparatus 100. In other embodiments, a dedicated engine is provided that powers the various components of the hydro excavation apparatus 100 or the apparatus 100 is powered by other methods.

Figures 2A, 2B:
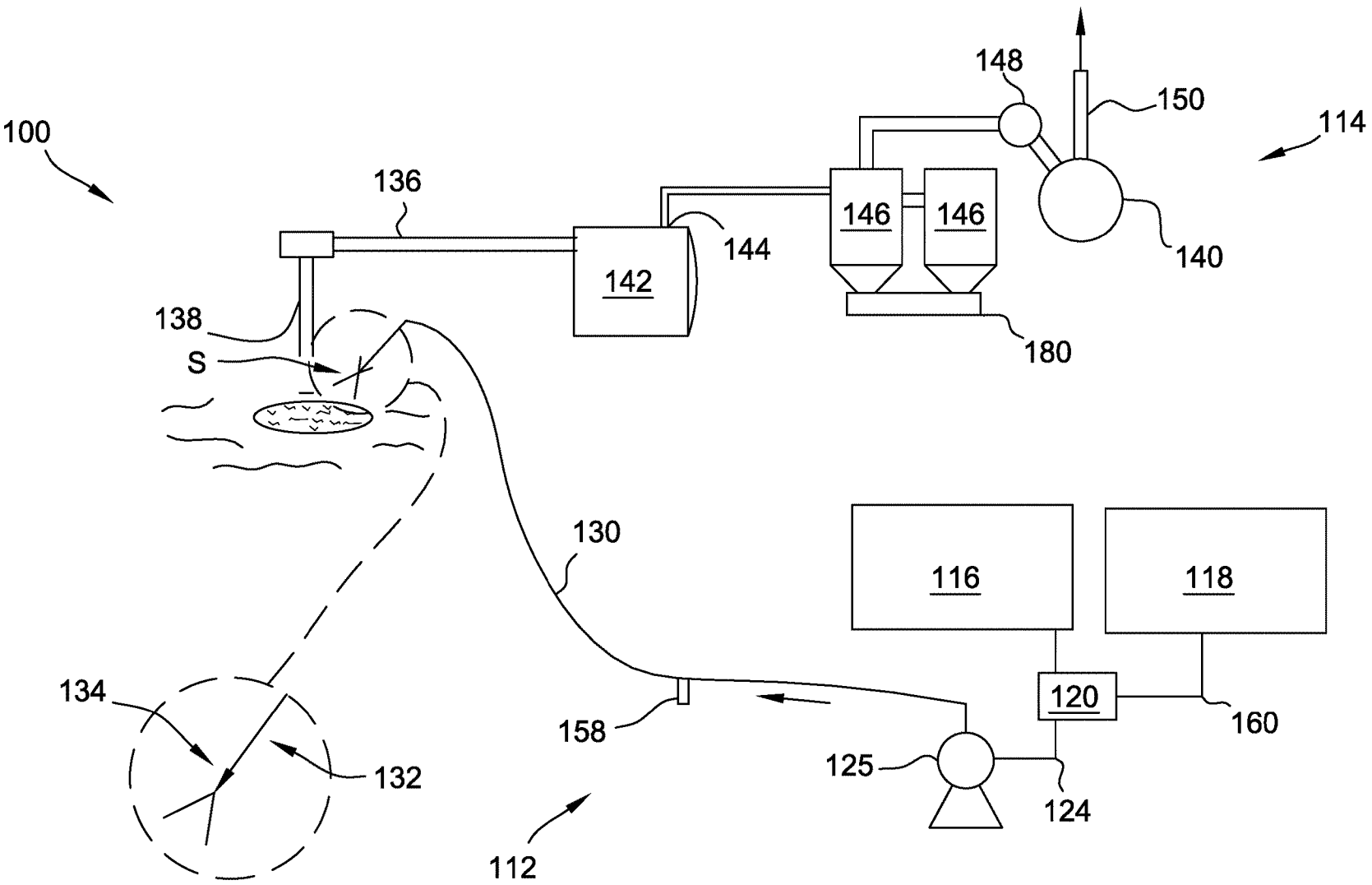
FIG. 2A is a schematic of a fluid supply system and a vacuum system of the hydro excavation vacuum apparatus shown in FIG. 1.
FIG. 2B is a detailed schematic view of the wand and wand nozzle.

Referring to FIGS. 2A and 2B, the hydro excavation vacuum apparatus 100 includes a fluid supply system 112 for dispensing an excavating fluid solution and a vacuum system 114. The fluid supply system 112 includes a base fluid reservoir 116, and additive reservoir 118, and an additive dosing assembly 120 for introducing additive from the additive reservoir 118 into the base fluid to form a mixed solution. In the example embodiment, the base fluid is water and the additive is any desired additive such as soap, detergent, surfactants, or friction reducing polymers. Example additives for use in the fluid supply system 112 include PRODYNE or PRODRILL (Pro-Action Fluids, LLC), common dish soap, and laundry detergent. The fluid supply system 112 is configured to mix the additive with the base fluid to form a mixed excavating fluid solution. By providing the additive in the fluid solution, the resulting discharged solution reduces the surface tension of the excavated soil, thereby reducing the tendency of spoil material to bond to and/or interfere with internal components of the vacuum system 114.

In the embodiment illustrated in FIG. 1, the base fluid reservoir 116 includes a plurality of water tanks 122 fluidly coupled to one another. The illustrated additive reservoir 118 is a tank (e.g., five quart) mounted on the chassis 102 between the water tanks 122 and the cab 108. In particular, the additive reservoir 118 is mounted on the chassis 102 adjacent the water tanks 122 and may be refilled by an operator standing at ground level near the chassis 102. In other words, the additive reservoir 118 may be refilled by an operator without having to climb onto the chassis 102. In other embodiments, the fluid supply system 112 may be coupled to an external base fluid source, such as a water supply truck or portable tank (not shown).

As shown in FIG. 2A, a first fluid supply line 124, also referred to herein as "first line" or "low pressure line," extends from the base fluid reservoir 116 to an excavation fluid pump 125. A dosing line 160 extends from the additive reservoir 118, through the additive dosing assembly 120, and to the first line 124. As described in greater detail below, the additive dosing assembly 120 controls release of additive from the additive reservoir 118 into the first fluid supply line 124 and enables selectively metering the volume of additive that is dispensed.

In the example embodiment the excavation fluid pump 125 is a motorized pump that is operable to pressurize the solution to, for example, at least about 500 psi or at least about 1,000 psi (e.g., from about 1,000 psi to about 5,000 psi or from 1,000 psi to about 3,000 psi). A second fluid supply line 130, also referred to herein as "second line" or "high pressure line," extends from the excavation fluid pump 125 to the wand 132. The second fluid supply line 130 supplies the pressurized solution to the wand 132. In the example embodiment, when the wand 132 is not releasing fluid, the excavation fluid pump 125 is configured to stop pumping fluid into the second fluid supply line 130, to prevent over pressurization of the fluid in the second fluid supply line 130. In particular, the pump 125 may be configured to stall and stop pumping based on the pressure and/or volume in the second fluid supply line 130 exceeding a threshold. In other embodiments, fluid supply system 112 further includes a relief circuit (not shown) operable to redirect the high-pressure fluid when the wand 132 is not releasing fluid, thereby preventing over pressurization of second fluid supply line 130. For example, in one embodiment the relief circuit extends from the pump 125 and/or second fluid supply line 130 at a point upstream of the flow sensor 158 and to the base fluid reservoir 116. In such embodiments, diverting the pressurized fluid into the relief circuit upstream of the flow sensor 158 may prevent additive dosing of the recirculated fluid. The first and second lines 124, 130 may be any structure or combination of structures suitable for fluid flow such as pipes, conduits, hoses, or the like.

In the example embodiment, the additive dosing assembly 120 is positioned upstream of the excavation fluid pump 125 such that the fluid received at the excavation fluid pump 125 includes both the base fluid and the additive (i.e., when additive addition is selected as described more fully below).

As a result, in the example embodiment, operation of the excavation fluid pump 125 provides additional mixing of the additive with the base fluid. In other embodiments, the additive dosing assembly 120 is coupled to the second fluid supply line 130. In some such embodiments, the additive dosing assembly 120 may also include a pressurized valve (not shown) to direct the low pressure additive into the pressurized base fluid within the second fluid supply line 130.

The pressurized solution flows through the second fluid supply line 130 from the excavation fluid pump 125 to the wand 132, which directs the pressurized solution toward earthen material to cut the earthen material. The wand 132 includes a nozzle 134 (e.g., rotary nozzle or straight tip nozzle) for directing the pressurized solution toward the earthen material to cut the earthen material.

The hydro excavation vacuum apparatus 100 includes the vacuum system 114 (FIG. 1) for removing spoil material from the excavation site. Spoil material or simply "spoils" may include, without limitation, soil such as rocks and/or clay, cut earthen material (e.g., small particulate such as sand to larger pieces of earth that are cut loose by the jet of high-pressure solution), slurry, organic/vegetative material such as grass, roots, and sticks, and solution used for excavation. The spoil material may have a consistency similar to water, a slurry, or even solid earth or rocks. The terms used herein for materials that may be processed by the hydro excavation vacuum apparatus 100 such as, for example, "spoils," "spoil material," "cut earthen material" and "water", should not be considered in a limiting sense unless stated otherwise.

The vacuum system 114 may include a boom 136 that is capable of rotating toward the excavation site to remove material from the excavation site. The boom 136 includes a dig tube 138 that extends downward to the ground to vacuum spoil material from the excavation site. The dig tube 138 may be manipulated by a user to direct the vacuum suction toward the excavation site. In other embodiments, the vacuum system 114 includes the dig tube 138 and does not include the boom 136.

The vacuum system 114 acts to entrain the cut earth and the solution used to excavate the site in a stream of air. A blower or vacuum pump 140 (FIG. 2A) pulls a vacuum through the boom 136 to entrain the material in the airstream. Air is discharged from the blower 140 after material is removed from the airstream.

The airstream having solution and cut earth entrained therein is pulled through the boom 136 and is pulled into a collection tank 142. Air exits one or more collection tank 142 air outlets 144 and is introduced into cyclones 146 (FIG. 2) to remove additional spoil material (e.g., water, small solids such as sand, low density particles such as sticks and grass, and the like) not separated in the collection tank 142. Material that collects in the bottom of the cyclones 146 is collected in collection chamber 180. Solids from the collection chamber 180 and collection tank 142 may be loaded into a bin, dumpster, loader bucket, ground pile, roll-off bin, dump truck or the like or may be conveyed to the site of the excavation as backfill. Solids may be transported off of the excavation apparatus 100 by other methods. The air removed from the cyclones 146 is introduced into one or more filter elements 148 before entering the vacuum pump 140. Air is removed from the apparatus through a vacuum exhaust 150.

The vacuum pump 140 generates vacuum in the system to pull solution and cut earthen material into the apparatus 100 for processing. In some embodiments, the vacuum pump 140 is a positive displacement pump. Such positive displacement pumps may include dual-lobe or tri-lobe impellers (e.g., a screw rotor) that draw air into a vacuum side of the pump and forces air out the pressure side. In some embodiments, the pump is capable of generating a vacuum of at least 18" Hg and/or a flow rate of at least about 3000 cubic feet per minute. The pump may be powered by a motor having a power output of, for example, at least 75 hp, at least 100 hp or even at least 125 hp.

Figure 3:
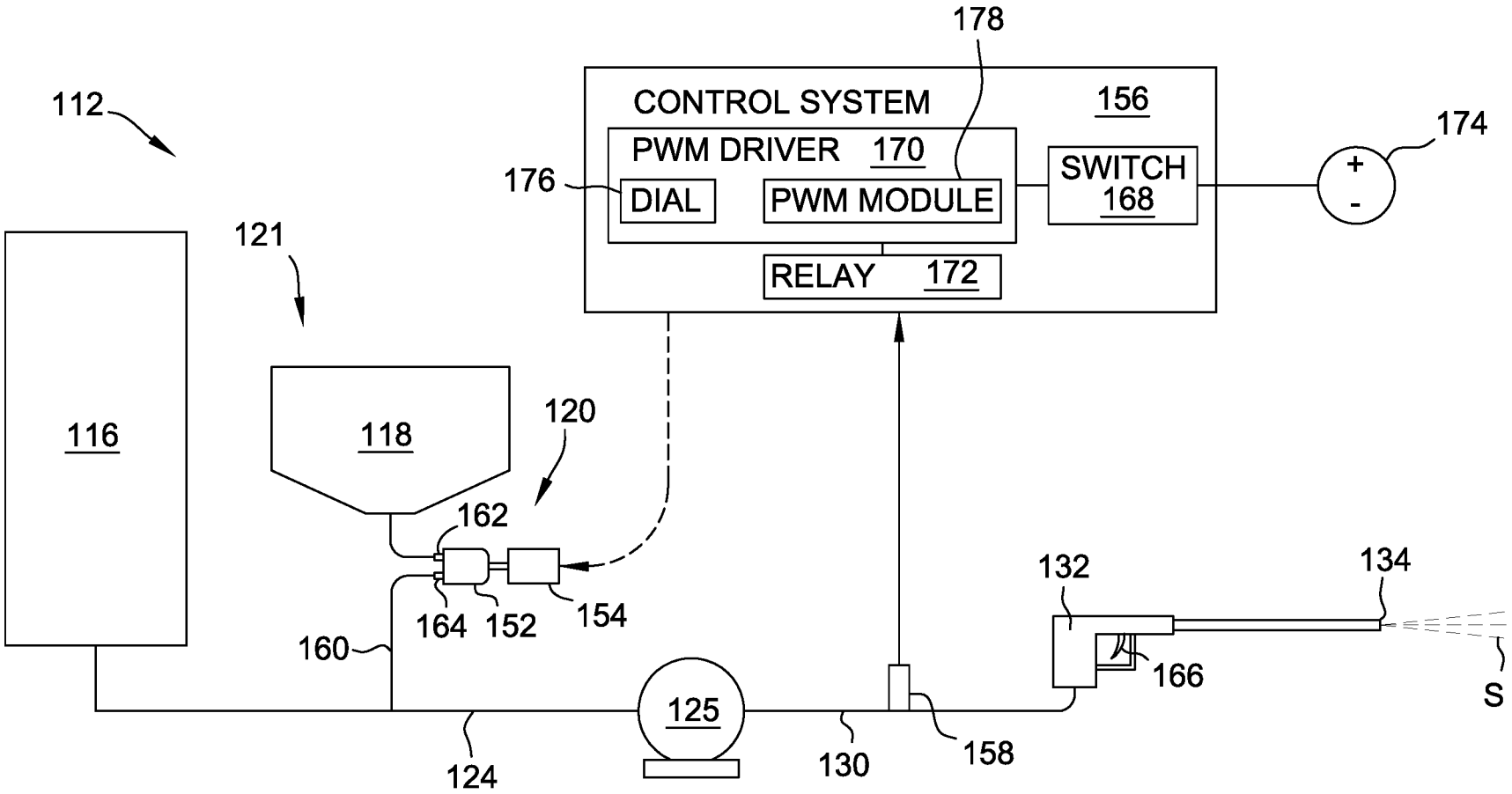
FIG. 3 is a detailed schematic of the fluid supply system shown in FIG. 2A.

FIG. 3 is a schematic of the fluid supply system 112 which includes an additive dosing system 121. In the example embodiment, the additive dosing system 121 includes the additive reservoir 118, the dosing assembly 120, a control system 156, and a flow sensor 158 for measuring the flow of fluid within the second fluid supply line 130. The dosing assembly 120 includes a dosing pump 152 and a dosing motor 154. The dosing line 160 extends from the additive reservoir 118 through the dosing pump 152 and to the first fluid supply line 124. In other embodiments, the dosing line 160 may introduce the additive into the second fluid supply line 130 (i.e., downstream of the excavation fluid pump 125). By introducing the additive into the one of the fluid supply lines 124, 130, a desired additive concentration in the discharged excavating solution may be maintained and/or selectively adjusted, without having to batch dose the base fluid in the base fluid reservoir 116. Although the dosing pump 152 and dosing motor 154 are shown and described as separate components herein, it will be understood that in other embodiments, the dosing motor 154 and the dosing pump 152 may be provided as a single component.

In some embodiments, the dosing line 160 introduces the additive into the base fluid reservoir 116. In such an embodiment, the base fluid stored in the base fluid reservoir may be "batch dosed," in that the pump may be operated until a predetermined volume of additive has been released into the base fluid reservoir 116, such that the resulting solution in the base fluid reservoir 116 has a desired additive concentration. In some such embodiments, the base fluid reservoir 116 further includes a mixing apparatus for mixing the additive with the base fluid in the base fluid reservoir 116. Suitable mixing apparatuses include, for example and without limitation, a recirculation loop, rotatable paddles, etc.

In yet further embodiments, the dosing line 160 may be branched, such that a first branch extends to the base fluid reservoir 116 and a second branch extends to the first fluid supply line and/or the second fluid supply line 130. In such embodiments, a valve may be provided to selectively control the flow of additive into either one of the branches. As a result, in such embodiments, an operator may control the valve and the control system 156 to perform either a batch dosing of the base fluid reservoir 116 or to selectively dose the base fluid released from the base fluid reservoir 116, e.g., as shown in FIG. 3.

In the example embodiment, the dosing pump 152 is a positive displacement pump and is configured to selectively meter additive from the additive reservoir 118 into the first fluid supply line 124. In the example embodiment, the dosing pump 152 is a peristaltic pump that includes an inlet 162 and an outlet 164 and a flexible tubing (not shown) extending between the inlet 162 and outlet 164. The dosing pump 152 is operatively coupled to and driven by the dosing motor 154. The dosing pump 152 is operable to provide a consistent metered volume of additive to the first fluid supply line 124 during rotation of the pump, irrespective of changes in the additive viscosity. In particular, because dosing pump 152 is a positive displacement pump, rotation of the rotor (not shown) by the dosing motor 154 isolates and moves a fixed volume of fluid from the inlet 162 to the outlet 164, irrespective of the viscosity of the additive. Accordingly, the dosing pump 152 of the present disclosure allows for a predetermined volume of additive to be introduced into first fluid supply line 124 based on operation of the dosing motor 154.

A flow sensor 158 is coupled to the second fluid supply line 130 and is operable to detect at least one characteristic of fluid flowing through the second fluid supply line 130. In the example embodiment, the flow sensor 158 is a binary flow sensor operable to detect whether fluid is flowing through the second fluid supply line 130 and out of the wand 132. In other embodiments, the flow sensor 158 is a volumetric flow sensor and detects a flow rate of fluid through the second fluid supply line 130.

Although shown positioned on the second fluid supply line 130 in FIG. 3, in other embodiments, the flow sensor 158 may integrated into the wand 132, the first fluid supply line 124, and/or the excavation fluid pump 125. For example, in some embodiments the flow sensor 158 is a proximity sensor on the wand 132 that detects when a trigger 166 of the wand is depressed, and fluid is released from the nozzle 134. In another embodiment, the flow sensor 158 is integrated into the excavation fluid pump 125 and is operable to detect the flow of fluid from the excavation fluid pump 125 and into the second fluid supply line 130. Moreover, although only a single flow sensor 158 is shown in the embodiment of FIG. 3, in other embodiments, the fluid supply system 112 may include a plurality of flow sensors coupled to various components of the fluid supply system 112.

The control system 156 is communicatively coupled with the flow sensor 158 and the dosing motor 154 and is configured to control the additive dosing assembly 120 based, at least in part, on whether fluid flow is detected by the flow sensor 158. The control system 156 controls operation of the dosing motor 154 to selectively release additive by the dosing pump 152 into the first fluid supply line 124, such that the resulting mixed solution has a desired additive concentration. For example, during operation, when the wand 132 is not in use (i.e., the trigger 166 is not depressed and fluid is not released from nozzle 134), the mixed solution in the second fluid supply line 130 does not flow and the flow sensor 158 therefore does not detect any fluid flow. As a result, the control system 156 does not provide power to the dosing motor 154 and additive is not released from the additive reservoir 118 into the first fluid supply line 124. When the trigger 166 on the wand 132 is depressed and fluid is released from the wand 132, the flow sensor 158 detects the resulting fluid flow in the second fluid supply line 130. In response, the control system 156 controls the dosing motor 154 to operate the dosing pump 152, thereby directing additive into the first fluid supply line 124. Controlling the additive dosing assembly 120 based on the flow of fluid in the second fluid supply line 130 and out of the wand 132 allows for maintaining a consistent additive concentration in the mixed solution released from the wand 132 and prevents overdosing the base fluid during periods when flow out of the wand 132 is stopped.

The control system 156 includes a switch 168, a pulse width modulation ("PWM") driver 170, and a relay 172. The PWM driver 170 is electrically connected to an external power source 174 by the switch 168 and controls power provided from the power source 174 to the dosing motor 154. The power source 174 may be a direct current ("DC") battery though, in other embodiments, any suitable power source may be used.

The PWM driver 170 includes a dial 176 and a PWM module 178. The PWM module 178 regulates an effective applied voltage provided to the dosing motor 154 from the power source 174 by changing a duty ratio of the received DC voltage at a given frequency. The dial 176 allows for selective adjustment of effective voltage controlled by the PWM module 178. By adjusting the dial 176, an operator may selectively adjust the speed of the dosing motor 154, and thereby control the volume of additive introduced into the base fluid during operation. For example, adjusting the dial 176 to increase the motor speed will increase the volume of additive introduced by the dosing pump 152 into the first fluid supply line 124. Decreasing the motor speed will decrease the volume of additive introduced by the dosing pump 152 into the first fluid supply line 124. Thus, the dial 176, and more broadly, the control system 156 enable selective adjustment of the volume of additive metered by dosing pump 152.

The switch 168 is a toggle switch that is moveable between an "on" position and an "off" position. When the switch 168 is in the "on" position, 12 volts of DC power is supplied to the PWM module 178 from the external power source 174 and the control system 156 controls the motor 154 based on the flow sensor 158. When the switch 168 is in the "off" position, the PWM driver 170 is electrically disconnected from the power source 174. When the fluid supply system 112 is operated with the switch 168 in the "off" position, no additive is dispensed into the base fluid and only base fluid is discharged from the wand 132.

In the example embodiment, the dial 176 is adjustable between a low concentration setting and a high concentration setting (e.g., a mixed solution ranging from 8000 parts water to 1 part additive to 2000 parts water to 1 part additive). The high concentration setting is suitable for thicker soils having a high surface tension, such as clay soils. In other embodiments, the PWM driver 170 may be adjustable to provide any suitable desired additive concentration to the excavating solution. In the example embodiment the dial 176 is a manually operated dial, though in other embodiments any suitable dial may be used.

The relay 172 is electrically coupled to the flow sensor 158. When the flow sensor 158 detects fluid flow with the second fluid supply line 130, the flow sensor 158 transmits an electrical signal to the relay 172, thereby providing power to the relay 172 and allowing power to flow from the PWM Driver 170 to the dosing motor 154.

During operation, to add an additive into a solution, an operator first sets the switch 168 to the "on" position and adjusts the dial 176 on the PWM driver 170 based on a desired additive concentration. Power is supplied to the excavation fluid pump 125 and the wand trigger 166 is engaged by the operator, causing fluid to flow through the second fluid supply line 130 and releasing the flow of fluid from the wand 132. The flow of fluid in the second fluid supply line 130 is detected by the flow sensor 158, which transmits a signal to the relay 172. The relay 172 receives the signal and electrically connects the PWM driver 170 to the dosing motor 154 in response. The dosing motor 154 receives the modulated power from the PWM driver 170 and drives the dosing pump 152, thereby introducing additive into the first fluid supply line 124. When the trigger 166 on the wand 132 is released, fluid flow out of the wand 132 and in the second fluid supply line 130 is stopped. In response, transmission of the signal from the flow sensor 158 to the relay 172 is stopped, thereby stopping the transmission of power between the PWM driver 170 and the dosing motor 154 and halting operation of the dosing pump 152.

Figure 4:
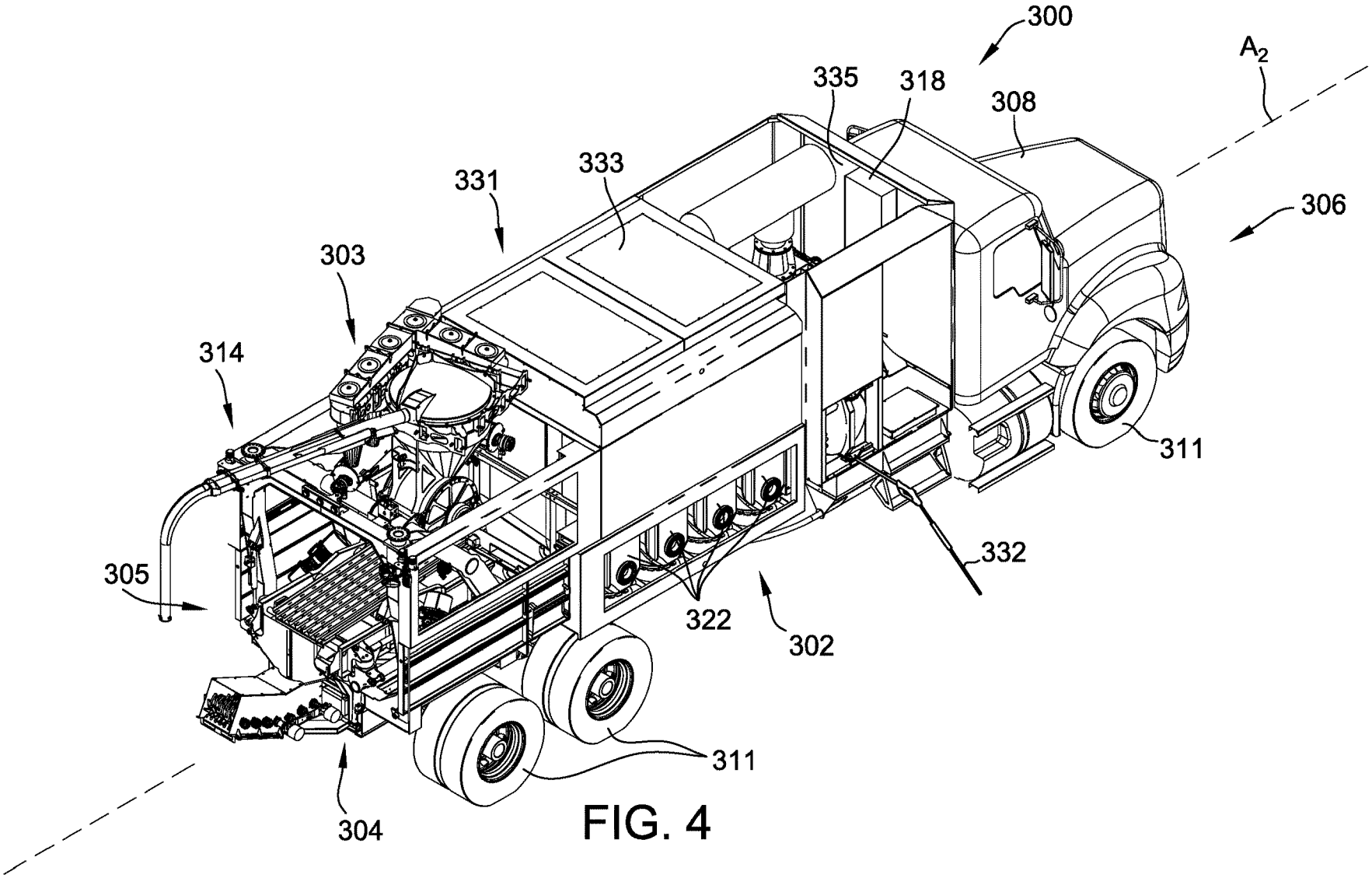
FIG. 4 is a perspective view of another embodiment of a hydro excavation vacuum apparatus.

Another embodiment of a hydro excavation vacuum apparatus 300 is shown in FIG. 4. The example hydro excavation vacuum apparatus 300 is substantially the same as the hydro excavation vacuum apparatus 100 described above with respect to FIGS. 1-3, except that, in the example embodiment, the hydro excavation vacuum apparatus 300 includes on-board processing (e.g., liquid-solid separation) of earthen material generated during excavation such as the apparatuses shown and described in U.S. Patent Publication No. 2019/0015766, entitled "Cyclonic Separation Systems and Hydro Excavation Vacuum Apparatus Incorporating Same", and in U.S. Patent Publication No. 2021/0087784, entitled "Systems and Methods for Reducing or Preventing Pluggage in an Excavation Vacuum Apparatus," both of which are incorporated herein by reference for all relevant and consistent purposes.

The illustrated hydro excavation vacuum apparatus 300 includes a high-pressure excavation fluid supply system 312, vacuum system 314, a separation system 303, and a dewatering system 305. The hydro excavation vacuum apparatus 300 includes a chassis 302 and wheels 311 connected to the chassis 302 to transport the hydro excavation vacuum apparatus 300. The hydro excavation vacuum apparatus 300 includes a rear 304, a front 306, and a longitudinal axis A2 that extends through the front 306 and the rear 304 of the hydro excavation vacuum apparatus 300. The hydro excavation vacuum apparatus 300 includes a cab 308 arranged near the front 306 and a truck 331 having a truck body 333. As shown in FIG. 4, in the example embodiment, the additive reservoir 318 is mounted to a forward sidewall 335 of the truck body 333.

Figure 5:
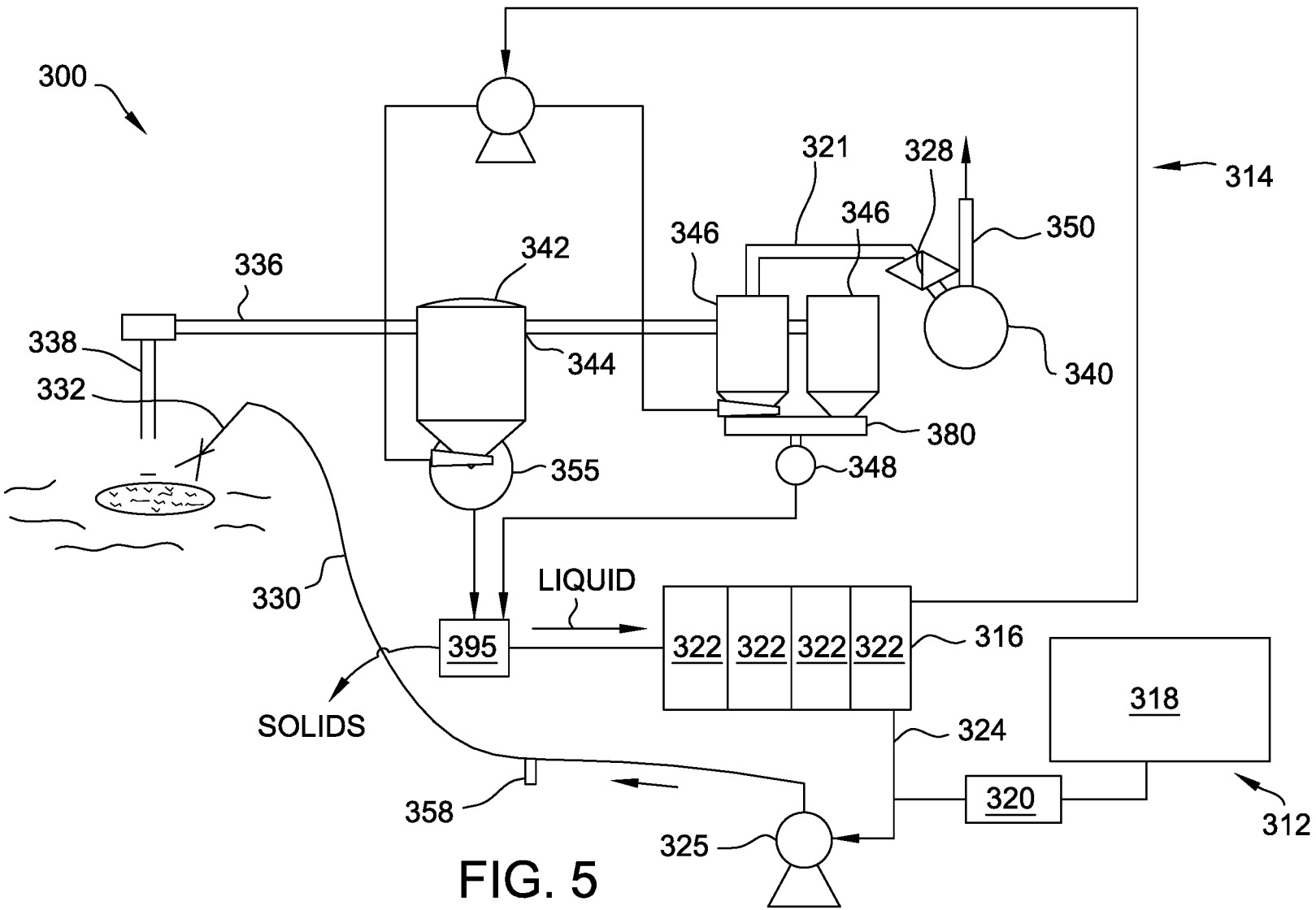
FIG. 5 is a schematic of a fluid supply system and a vacuum system of the hydro excavation vacuum apparatus shown in FIG. 4.

Referring to FIG. 5, the hydro excavation vacuum apparatus 300 includes a vacuum system 314 and a fluid supply system 312. The vacuum system 314 includes a dig tube 338 for entraining the material. The dig tube 338 is optionally carried by a boom 336 that is capable of rotating to position the dig tube 338 over the excavation site. A blower or vacuum pump 340 pulls a vacuum through the dig tube 338 to entrain the material in the airstream. Air is discharged from the blower 340 after spoil material is removed from the airstream.

The airstream having solution and cut earth entrained therein is pulled through the dig tube 338 and is pulled into a separation vessel 342. The separation vessel 342 removes at least a portion of cut earthen material and solution from the airstream. Air exits one or more separation vessel air outlets 344 and is introduced into cyclones 346 to remove additional spoil material (e.g., water, small solids such as sand, low density particles such as sticks and grass, and the like) not separated in the separation vessel 342. Spoil material discharged from the bottom of the cyclones 346 is conveyed by conveyor 380 to a cyclone discharge pump 348 and is introduced to a dewatering system 395 described below, or, alternatively, is gravity fed to the dewatering system 395. The air removed from the cyclones 346 is drawn through a vacuum tube 321 to be introduced into one or more filter elements 328 before entering the vacuum pump 340. Air is removed from the apparatus through a vacuum exhaust 350.

Spoil material falls within the separation vessel 342 toward the airlock 355. The material passes through the airlock 355 and is introduced into a dewatering system 395. The dewatering system of some embodiments includes a pre-screen (not shown) that first engages material discharged from the airlock 355. The dewatering system 395 also includes a vibratory screen, more commonly referred to as a "shaker", that separates material that passes through the pre-screen by size. Discharged solids may be loaded into a bin, dumpster, loader bucket, ground pile, roll-off bin, dump truck or the like or may be conveyed to the site of the excavation as backfill. Solids may be transported off of the excavation apparatus by other methods. Discharged liquids from the dewatering system 395 may be stored in tank(s) 322.

The hydro excavation apparatus 300 further includes a fluid supply system 312. The fluid supply system 312 includes a base fluid reservoir 316, additive reservoir 318, and an additive dosing assembly 320 for introducing additive from the additive reservoir 318 into the base fluid to form a mixed solution. The base fluid reservoir 316 supplies water for high pressure excavation and stores fluid recovered from the dewatering system 395. The base fluid reservoir 316 includes a plurality of tanks 322 fluidly coupled with one another. The fluid supply system 312 further includes a flow sensor 358 coupled to a second fluid supply line 330. The additive dosing assembly 320 is configured to introduce the additive from the additive reservoir 318 into the first fluid supply line 324 in response to the flow sensor 358 detecting fluid flow in substantially the same manner as described above with the respect the additive dosing assembly 120 described in FIGS. 1-3. However, in the example embodiment, base fluid reservoir 316 also receives recirculated base fluid from the dewatering system 395.

Figure 6:
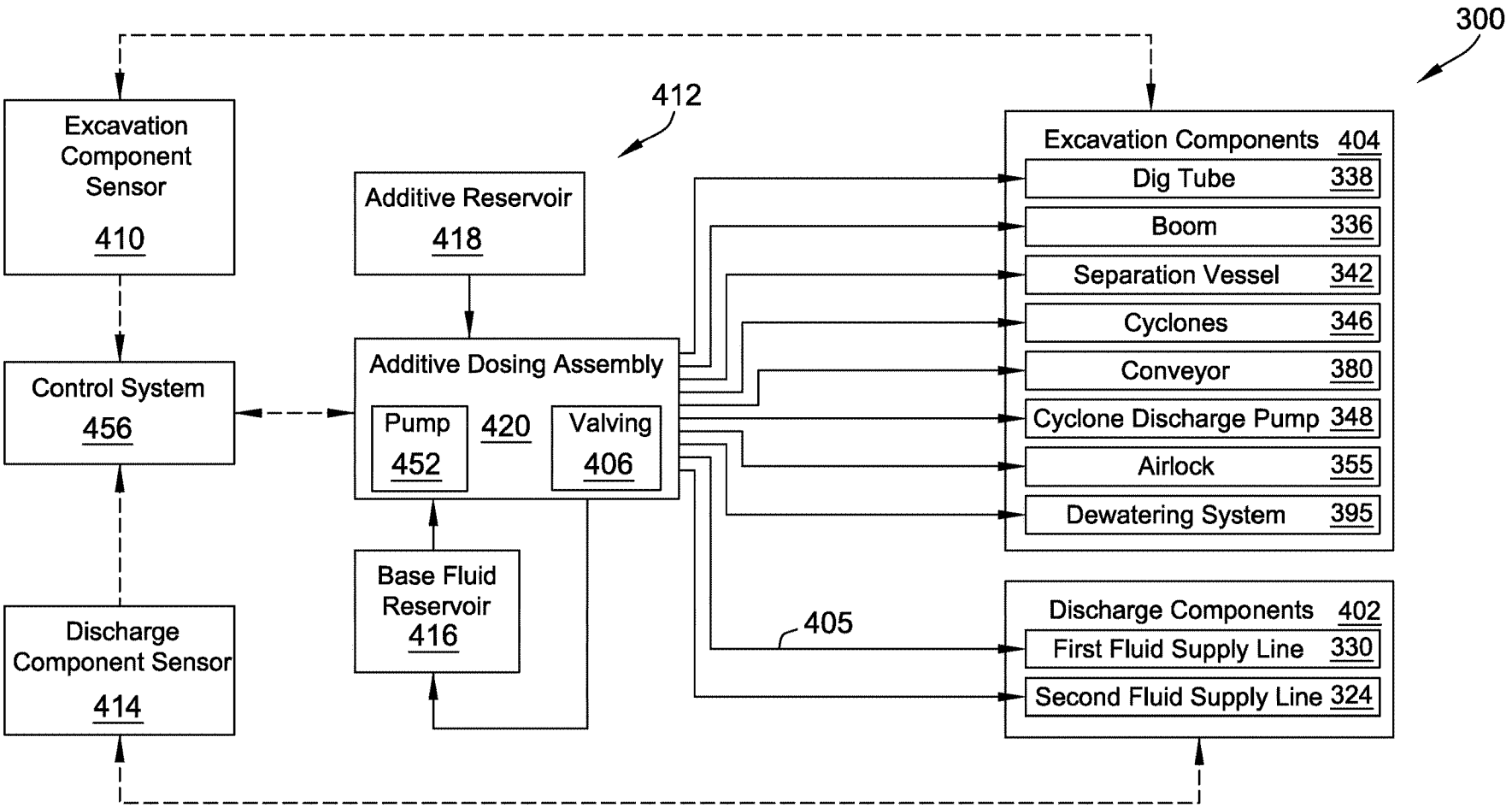
FIG. 6 is a schematic of another embodiment of a fluid supply system for use with the hydro excavation vacuum apparatuses shown in FIGS. 1-5.

FIG. 6 is another schematic view of hydro excavation apparatus 300 including another embodiment of a fluid supply system 412. The example fluid supply system 412 may be used with any suitable hydro excavation vacuum apparatus, such as the hydro excavation vacuum apparatus 100 described above with respect to FIGS. 1-3.

The example fluid supply system 412 is substantially the same as the fluid supply systems 112, 312 described with respect to FIGS. 1-3 and 4 and 5, respectively, except as described below. Specifically, the fluid supply system 412 of FIG. 6 is configured to supply a base fluid from base fluid reservoir 416, an additive from an additive reservoir 418, and/or a base fluid additive mixture to discharge components 402, such as first fluid supply line 330 and second fluid supply line 324 in substantially the same manner as described above relating to FIG. 2. Moreover, in the example embodiment, the fluid supply system 412 is further configured to supply the base fluid, additive, and/or the base fluid additive mixture to one or more excavation components 404 of a hydro excavation apparatus 300.

As used herein, the term "discharge components" includes any components of hydro excavation vacuum apparatuses 100, 300 that are used to dispense the excavating fluid. For example, referring back to FIG. 5, first fluid supply line 330, second fluid supply line 324, and any other components/conduits upstream of wand 332 and downstream of base fluid reservoir 316 are examples of discharge components 402. Additionally, as used herein, the term "excavation components" incudes any components that receive the cut earthen material excavated from the dig site. For example, the dig tube 338, boom 336, separation vessel 342, cyclones 346, conveyor 380, cyclone discharge pump 348, airlock 355, dewatering system 395, and any other components/conduits downstream of dig tube 338 and upstream of base fluid reservoir 316 are all examples of excavation components.

Referring back to FIG. 6, in the example embodiment, fluid supply system 412 includes a plurality of additive dosing lines 405 fluidly connecting additive dosing assembly 420 to each of excavation components 404 and discharge components 402. Fluid supply system 412 further includes a dosing line 405 extending to the base fluid reservoir 416 allowing for batch dosing of the base fluid contained within the reservoir 416. In other embodiments, additive dosing assembly 420 may be coupled to any combination of excavation components 404 and discharge components 402. For example, and without limitation, in some embodiments, fluid supply system 412 includes a first additive dosing line 405 extending to one of excavation components 404, a second additive dosing line 405 extending to one of discharge components 402 and does not include the other dosing lines 405 shown in FIG. 6.

Additive dosing assembly 420 includes a pump 452 and valving 406 fluidly connecting additive reservoir 418 and base fluid reservoir 416 to each of excavation components 404 and discharge components 402. The pump 452 may be a positive displacement pump, similar to pump 152 described above with respect to FIG. 1, a low pressure and/or high-volume pump, and, in some embodiments as described in greater detail below, may include a plurality of different pumps that are each configured to deliver the additive to specific ones of excavation components 404 and discharge components 402. The valving 406 includes selectively controllable valves provided on each additive dosing line 405.

Additive dosing assembly 420 is configured to selectively introduce additive from additive reservoir 418 and/or an additive and base fluid mixture into any one of discharge components and/or excavation components. Specifically, in the example embodiment, valving 406 includes valves provided on each additive dosing line 405 extending from additive dosing assembly 420 to each of excavation components 404 and discharge components 402. The control system 456 is communicatively coupled to additive dosing assembly 420, and specifically to valving 406 and/or valve controllers (not shown) associated with each valve, to provide selective control of introduction of additive into excavation components 404 and discharge components 402. Additionally or alternatively, in some embodiments, valving 406 is manually controllable and operators may manually open one or more valves of valving to introduce additive into one of excavation components and discharge components.

In the example embodiment, additive dosing assembly 420 is further configured to control an amount of additive and base fluid introduced to excavation components 404 and discharge components 402. For example, additive dosing assembly 420 may be controlled to provide undiluted additive (i.e., without base fluid mixed therein) to excavation components 404. Specifically, in the example, valving 406 may also include one or more valves for controlling introduction of additive from additive reservoir 418 or base fluid from base fluid reservoir 416 to excavation components 404 and/or discharge components 402.

In some embodiments, additive dosing assembly 420 may include a plurality of pumps 452 based on the location at which the additive is added within the hydro excavation vacuum apparatus 300. For example, and without limitation, in some embodiments pump 452 may include two or more pumps 452, including a first low volume pump for introducing additive into pressurized environments of discharge components 402, such as a peristaltic pump. Pump 452 may also include a second pump having a different configuration from the first pump, such as a comparatively higher volume pump, for introducing the additive in components at ambient pressure, such as at the base fluid reservoir 416 and/or at a shaker deck/tray or screen (not shown) of the apparatus 300. Moreover, a different pump may be used for introducing the additive into a vacuum or negative pressure environment, such as at dig tube 338, boom 336, separation vessel 342, airlock 355, cyclones 346, pump 348, and conveyor 380.

In the example embodiment, fluid supply system 412 further includes an excavation component sensor 410 and a discharge component sensor 414. The control system 456 is communicatively coupled to the excavation component sensor 410 and the discharge component sensor 414 and is configured to control additive dosing assembly 420 to release additive and/or additive base fluid mixture to discharge components 402 and excavation components 404 based on readings detected by sensors 410, 414. In the example embodiment, the discharge component sensor 414 is a flow sensor that is substantially the same as sensor 158, shown in FIG. 3.

In the example embodiment, excavation component sensor 410 is configured to detect flow of fluid, such as removed spoil material and base fluid, through excavation components 404. More specifically, in the example embodiment, the excavation component sensor 410 is a pluggage detection sensor that is substantially similar to the sensor system 130 shown and described in U.S. Patent Publication No. 2019/0015766, the entire contents of which are incorporated herein by reference for all relevant and consistent purposes. That is, the excavation component sensor 410 is configured to detect the weight of one or more of excavation components 404 and/or the weight of the spoil material contained within the excavation components 404 to determine whether there is a pluggage or "clogging" in one or more of excavation components 404. In some embodiments, excavation component sensor 410 includes multiple sensors and is configured to detect a weight of each of excavation components 404 individually. In other embodiments, excavation component sensor 410 is configured to detect a total weight of all excavation components 404 and/or a subset of excavation components 404, such as, for example, excluding the dewatering system 395, dig tube 338, and boom 336.

In the example embodiment, control system 456 is configured to automatically control additive dosing assembly 420 to release additive and/or an additive base fluid mixture in response to a detected weight of one or more of excavation components 404 exceeding a predetermined threshold. In some embodiments where excavation component sensor 410 is configured to measure a weight of specific excavation components 404, control system 456 automatically controls additive dosing assembly 420 to release additive into the excavation component 404 where the excess weight was detected. In some embodiments, control system 456 is further configured to determine an amount of and/or a rate at which to introduce the additive into the corresponding component based on the weight detected by the excavation component sensor 410. Introduction of the additive softens spoil material trapped within the corresponding component, to free up or prevent the accumulation of clogs.

In other embodiments, the fluid supply system 412 does not include at least one of the excavation component sensor 410 and the discharge component sensor 414. In such embodiments, in response to a clogging, an operator may manually control valving of additive dosing assembly 420 to release additive into an excavation component 404 that it is expected to be most effective at alleviating the clogging based on the operator's knowledge and experience and other observable characteristics of the apparatus 300.

Although described herein with respect to the hydro excavation vacuum apparatus 300 of FIGS. 4 and 5, in other embodiments the fluid supply system 412 of FIG. 6 may be used with the hydro excavation vacuum apparatus 100 of FIGS. 1-3. For example, in some such embodiments, the fluid supply system 412 includes additive dosing lines 405 that extend to excavation components 404 of the hydro excavation vacuum apparatus 100 of FIG. 2, such as the dig tube 138, the boom 136, the collection tank 142, the cyclones 146, the collection chamber 180, and/or any other components/conduits provided downstream of the dig tube 138. Additionally, in some such embodiments, the fluid supply system 412 further includes additive dosing lines 405 that extend to discharge components 402 of the hydro excavation vacuum apparatus 100 of FIG. 2, such as the first fluid supply line 330, the second fluid supply line 324, and/or any other components/conduits provided upstream of the nozzle 134.

Moreover, in some embodiments, the additive dosing assembly includes only one of the valving 406 and pump 452. For example, in some embodiments, it may not be necessary to use the pump 452 to provide additive to at least one or more of the excavation components 404. In some such embodiments, to introduce the additive into such components, opening the corresponding valve is sufficient to allow the additive to dispense under gravity into such components. In other embodiments where the additive is introduced into a negative pressure environment, the pump 452 may also optionally be removed and the negative pressure may be sufficient to suck the additive into the environment for dispensing.

Control system 456, the various logical blocks, modules, and circuits described herein may be implemented or performed with a general purpose computer, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. Example general purpose processors include, but are not limited to, microprocessors, conventional processors, controllers, microcontrollers, state machines, or a combination of computing devices.

In some embodiments, control system 456 includes a processor, e.g., a central processing unit (CPU) of a computer for executing instructions. Instructions may be stored in a memory area, for example. Processor may include one or more processing units, e.g., in a multi-core configuration, for executing instructions. The instructions may be executed within a variety of different operating systems on the controller, such as UNIX, LINUX, Microsoft Windows®, etc. It should also be appreciated that upon initiation of a computer-based method, various instructions may be executed during initialization. Some operations may be required in order to perform one or more processes described herein, while other operations may be more general and/or specific to a particular programming language e.g., and without limitation, C, C #, C++, Java, or other suitable programming languages, etc.

Processor may also be operatively coupled to a storage device. Storage device is any computer-operated hardware suitable for storing and/or retrieving data. In some embodiments, storage device is integrated in control system 456. In other embodiments, storage device is external to controller and is similar to database. For example, control system 456 may include one or more hard disk drives as storage device. In other embodiments, storage device is external to controller. For example, storage device may include multiple storage units such as hard disks or solid state disks in a redundant array of inexpensive disks (RAID) configuration. Storage device may include a storage area network (SAN) and/or a network attached storage (NAS) system.

In some embodiments, processor is operatively coupled to storage device via a storage interface. Storage interface is any component capable of providing processor with access to storage device. Storage interface may include, for example, an Advanced Technology Attachment (ATA) adapter, a Serial ATA (SATA) adapter, a Small Computer System Interface (SCSI) adapter, a RAID controller, a SAN adapter, a network adapter, and/or any component providing processor with access to storage device.

Memory area may include, but are not limited to, random access memory (RAM) such as dynamic RAM (DRAM) or static RAM (SRAM), read-only memory (ROM), erasable programmable read-only memory (EPROM), electrically erasable programmable read-only memory (EEPROM), and non-volatile RAM (NVRAM). The above memory types are exemplary only, and are thus not limiting as to the types of memory usable for storage of a computer program.

Compared to conventional fluid supply systems for use in hydro excavation apparatuses, the fluid supply systems of the present disclosure have several advantages. In embodiments where the fluid supply system includes an additive dosing system that selectively releases additive into a fluid supply line, the base fluid may be selectively dosed to a desired concentration after it is released from the base fluid reservoir, i.e., without having to batch dose the entire base fluid reservoir. Selectively dosing the base fluid after it has exited the base fluid reservoir allows for the concentration of additive in the discharged fluid solution to be selectively adjusted without having to fully discharge the tank or manually change an additive concentration in the base fluid reservoir. In embodiments where the hydro excavation machine includes a liquid/solid separation system (e.g., as shown in FIGS. 4 and 5), it may be important to control the concentration of additive to promote efficient separation of solids from liquids. For example, at least some known separation systems include one or more filters, such as a shaker screen, that facilitate the separation of solids and liquids. When an over dosed solution is processed by the separation systems, the over dosed solution may form a film over the filters, resulting in an inefficient solid liquid separation. Additionally, overdosing the excavating solution with additive may lead to inefficient separation of liquid and solids because the solids are finely dispersed in the liquid due to the effects of the additive (reduced surface tension). In embodiments where the fluid supply system includes a flow sensor and a control system for controlling the additive dosing assembly to introduce the additive into the base fluid in response to the sensor detecting fluid flow, the desired additive concentration in the excavating solution may be maintained during periods when fluid is not being discharged from the wand. In embodiments where the fluid supply system includes a separate reservoir for holding the additive, the reservoir may be positioned at a location on the hydro excavation apparatus that is accessible to an operator, without requiring them to climb up (e.g., above the base fluid reservoir), to refill the additive. In embodiments, in which the additive system includes a dial for selecting the dose of additive to be added to the base fluid, the amount of additive may be selected based on soil conditions. In embodiments where the additive dosing system is configured to introduce the additive at different components of the hydro excavation apparatus, the additive dosing system may be selectively controlled to provide a targeted release to specific components of the apparatuses to reduce clogging and improve flow of spoil material through excavation components of the hydro excavation apparatus. In embodiments where the hydro excavation apparatus includes an excavation component sensor, the additive dosing system may be automatically controlled to release the additive to a corresponding clogged area based on readings from the sensor.

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing[s] shall be interpreted as illustrative and not in a limiting sense.

What is claimed is:

1. A hydro excavation apparatus for excavating earthen material comprising:

a first reservoir for holding a base fluid therein;

a second reservoir for holding an additive therein;

a vacuum system for removing earthen material from an excavation site;

an additive dosing assembly including at least one of a pump and a valve fluidly connected to the second reservoir, the additive dosing assembly being selectively controllable to introduce the additive into the base fluid to form a mixed fluid solution;

a wand for directing the mixed fluid solution toward earthen material at an excavation site to cut the earthen material;

a sensor for detecting a flow of fluid between the wand and the first reservoir; and a control system communicatively coupled to the additive dosing assembly to control addition of additive into the base fluid based at least in part on the sensor detecting fluid flow between the wand and the first reservoir.

2. The hydro excavation apparatus of claim 1, wherein the additive dosing assembly is configured to introduce the additive into a pressurized fluid line containing the base fluid.

3. The hydro excavation apparatus of claim 1, wherein the additive dosing assembly is configured to introduce the additive into the base fluid in at least one of a non-pressurized fluid line and a non-pressurized chamber.

4. The hydro excavation apparatus of claim 1 further comprising an excavation component for receiving the removed earthen material, wherein the additive dosing assembly is configured to introduce the additive into the removed earthen material within the excavation component.

5. The hydro excavation apparatus of claim 4, wherein the excavation component is configured to provide a negative pressure environment and wherein the additive dosing assembly is configured to introduce the additive into the negative pressure environment of the excavation component.

6. The hydro excavation apparatus of claim 1 further comprising a chamber for storing the removed earthen material.

7. The hydro excavation apparatus of claim 1 further comprising:

a separation vessel for removing the earthen material and mixed fluid solution from an airstream of the vacuum system; and a dewatering system for separating fluid from the removed earthen material received from the separation vessel.

8. The hydro excavation apparatus of claim 7, wherein the additive dosing assembly is configured to introduce the additive into at least one of the separation vessel and the dewatering system.

9. The hydro excavation apparatus of claim 1 further comprising a collection reservoir for storing the removed earthen material therein, wherein the additive dosing assembly is configured to introduce additive into the earthen material upstream of the collection reservoir.

10. The hydro excavation apparatus of claim 1, wherein the additive dosing assembly includes the pump, the pump having a motor, and wherein the control system is communicatively coupled to the motor, the control system being selectively adjustable to control a speed of the motor, and wherein changing a speed of the motor changes a rate at which the pump introduces the additive into the base fluid.

11. The hydro excavation apparatus of claim 1, wherein the control system comprises a selectively positionable switch for activating the additive dosing assembly.

12. A hydro excavation apparatus for excavating earthen material comprising:

a reservoir for holding a base fluid therein;

an additive dosing assembly for introducing an additive into the base fluid to form a mixed fluid solution;

a wand for directing the mixed fluid solution toward earthen material at an excavation site to cut the earthen material;

a vacuum system for removing the cut earthen material and the mixed fluid solution from the excavation site;

a sensor for detecting a flow of fluid between the wand and the reservoir; and a control system communicatively coupled to the additive dosing assembly to control addition of additive into the base fluid based at least in part on the sensor detecting fluid flow between the wand and the reservoir.

13. The hydro excavation apparatus of claim 12, wherein the additive dosing assembly comprises a positive displacement pump and a motor operatively connected to the positive displacement pump.

14. The hydro excavation apparatus of claim 12 further comprising an excavation fluid pump fluidly connected between the reservoir and the wand and operable to pressurize fluid supplied to the wand.

15. The hydro excavation apparatus of claim 12, wherein the control system comprises:

a selectively positionable switch for activating the additive dosing assembly;

a pulse width modulation (PWM) driver including a PWM module for regulating an effective applied voltage provided to the additive dosing assembly, the PWM module further including a dial for selectively adjusting a setting of the PWM module; and a relay communicatively coupled to the sensor and the additive dosing assembly.

16. A method for controlling a hydro excavation apparatus, the method comprising:

providing a base fluid reservoir storing a base fluid therein;

providing an additive dosing assembly including at least one of a pump and a valve that is fluidly connected to an additive reservoir storing an additive therein;

controlling, by a control system communicatively coupled to the additive dosing assembly, the additive dosing assembly to selectively introduce the additive into the base fluid to form a mixed fluid solution;

cutting earthen material at an excavation site using a wand to direct the mixed fluid solution toward the earthen material;

controlling a vacuum system to remove the cut earthen material and the mixed fluid solution from the excavation site; and detecting, by a sensor, a flow of fluid between the wand and the base fluid reservoir, wherein the control system controls addition of additive into the base fluid based at least in part on the detected fluid flow between the wand and the base fluid reservoir.

17. The method of claim 16, wherein controlling the additive dosing assembly comprises introducing the additive into a pressurized fluid line containing the base fluid.

* * * * *